US009650110B1

(12) United States Patent
Lindblade

(10) Patent No.: US 9,650,110 B1
(45) Date of Patent: May 16, 2017

(54) DISCONNECTABLE TOWER YOKE ASSEMBLY AND METHOD OF USING SAME

(71) Applicant: SOFEC, Inc., Houston, TX (US)

(72) Inventor: Stephen P. Lindblade, Waller, TX (US)

(73) Assignee: SOFEC, Inc., Houston, TX (US)

( * ) Notice: Subject to any disclaimer, the term of this patent is extended or adjusted under 35 U.S.C. 154(b) by 0 days.

(21) Appl. No.: 14/923,770

(22) Filed: Oct. 27, 2015

(51) Int. Cl.
*B63B 22/02* (2006.01)
*B63B 21/00* (2006.01)

(52) U.S. Cl.
CPC ..... *B63B 21/00* (2013.01); *B63B 2021/002* (2013.01)

(58) Field of Classification Search
CPC ..... B63B 21/00
See application file for complete search history.

(56) References Cited

U.S. PATENT DOCUMENTS

| | | | | |
|---|---|---|---|---|
| 4,114,556 | A | 9/1978 | Orndorff, Jr. et al. | |
| 4,191,256 | A * | 3/1980 | Croy | E21B 33/037 141/387 |
| 4,516,942 | A | 5/1985 | Pedersen | |
| 6,227,135 | B1 | 5/2001 | Pedersen | |
| 6,923,225 | B2 | 8/2005 | Poldervaart et al. | |
| 7,007,623 | B2 | 3/2006 | Boatman et al. | |
| 2014/0014017 | A1 * | 1/2014 | Balleraud | B63B 22/025 114/230.15 |

OTHER PUBLICATIONS

Wellman Dynamics Machining and Assembly Inc. "The Most Reliable Locking Device BEAR-LOC." York, PA. <http://www.wdmachining.com>, undated.

* cited by examiner

*Primary Examiner* — Stephen Avila
(74) *Attorney, Agent, or Firm* — Douglas W. Rommelmann; Andrews Kurth Kenyon LLP

(57) ABSTRACT

A disconnectable rigid mooring system for attaching a ship to a tower structure includes a yoke releasably connected to a yoke head. The yoke head is pivotally attached to the tower structure and the yoke is arranged and designed to attach to the ship. The yoke and the yoke head each have a mating connector portion arranged and designed to connect the yoke to the yoke head. When the connector portions are engaged and locked, the yoke is securely attached to the yoke head, allowing a rigid interconnection between the ship and the tower structure. During normal operations and in normal sea states, the yoke remains connected to the yoke head pivotally attached to the tower structure. In the event of predicted abnormally high sea states, the yoke may be disconnected from the yoke head by the ship and be secured to the ship and removed prior to the abnormally high sea state event. The yoke and yoke head are provided with alignment guides and mechanisms which permit the yoke and yoke head to be properly aligned during the connect and disconnect procedures.

25 Claims, 5 Drawing Sheets

DISCONNECTABLE TOWER YOKE ASSEMBLY AND METHOD OF USING SAME

BACKGROUND OF THE INVENTION

1. Field of the Invention

The present invention relates generally to a rigid mooring system for use in attaching a floating vessel or ship to a tower structure attached to the sea floor. More particularly, the invention relates to a tower mooring system comprising a rigid tower yoke assembly having a yoke releasably attached to a yoke head via a connector allowing removal of the yoke by the ship in the event of predicted abnormally high sea states.

2. Description of the Related Art

Typical tower yoke mooring systems are permanent mooring systems where the floating vessel cannot leave for a storm. The typical tower yoke, single point mooring system includes a "soft yoke" for mooring a floating vessel directly to a fixed tower. A turntable is fastened to the tower, typically with a roller bearing, to allow the floating vessel to freely weathervane about the fixed tower. A yoke is connected to the turntable with pitch and roll joints to allow the vessel to pitch and roll. The yoke includes a large ballast tank adapted to be filled with water to provide the necessary restoring force to minimize vessel motions. Two mooring links suspend the ballast tank from a support structure mounted on the floating vessel.

Product, such as oil or gas for example, is transferred from the tower across swivels located on the turntable and through hoses from the turntable to the vessel. The tower includes deck space for a manifold and other equipment. Access to the tower can be made via walkways from the vessel and on the yoke.

However, some tower yoke mooring system applications in shallow water are needed in areas potentially subjected to large storms or extreme sea states such as hurricanes or typhoons, during which the floating vessel will leave the area. For purposes of safety and to survive the extreme sea states it is desirable that the tower yoke be disconnectable from the tower structure.

SUMMARY OF THE INVENTION

The present invention includes a disconnectable tower yoke for a large storm environment. The disconnectable tower yoke allows the yoke to be removed from the tower structure and remain with the floating vessel when disconnecting for a large storm. In a preferred embodiment, the disconnection takes place at a yoke head with a hydraulic connector. The yoke head includes a trunnion for pivotal movement relative to the tower structure. Preferably, a conical interface at the yoke to yoke head connection allows for alignment and connection of the yoke to the yoke head. A pull-in line attached to the yoke head trunnion housing serves as a guide for the yoke and yoke head during vessel pull-in and connection.

The preferred embodiment of the present invention further includes a frame, attached to the mooring support structure of the vessel, containing a motion compensated winch that allows for the yoke to be supported by the vessel and allows for reconnection of the yoke to the yoke head. Hoses and flow lines are disconnected at the tower structure and transferred to the vessel prior to disconnection.

BRIEF DESCRIPTION OF THE SEVERAL VIEWS OF THE DRAWINGS

The various aspects and advantages of the preferred embodiment of the present invention will become apparent to those skilled in the art upon an understanding of the following detailed description of the invention, read in light of the accompanying drawings which are made a part of this specification and in which.

DESCRIPTION OF THE PREFERRED EMBODIMENTS

Figure 1:
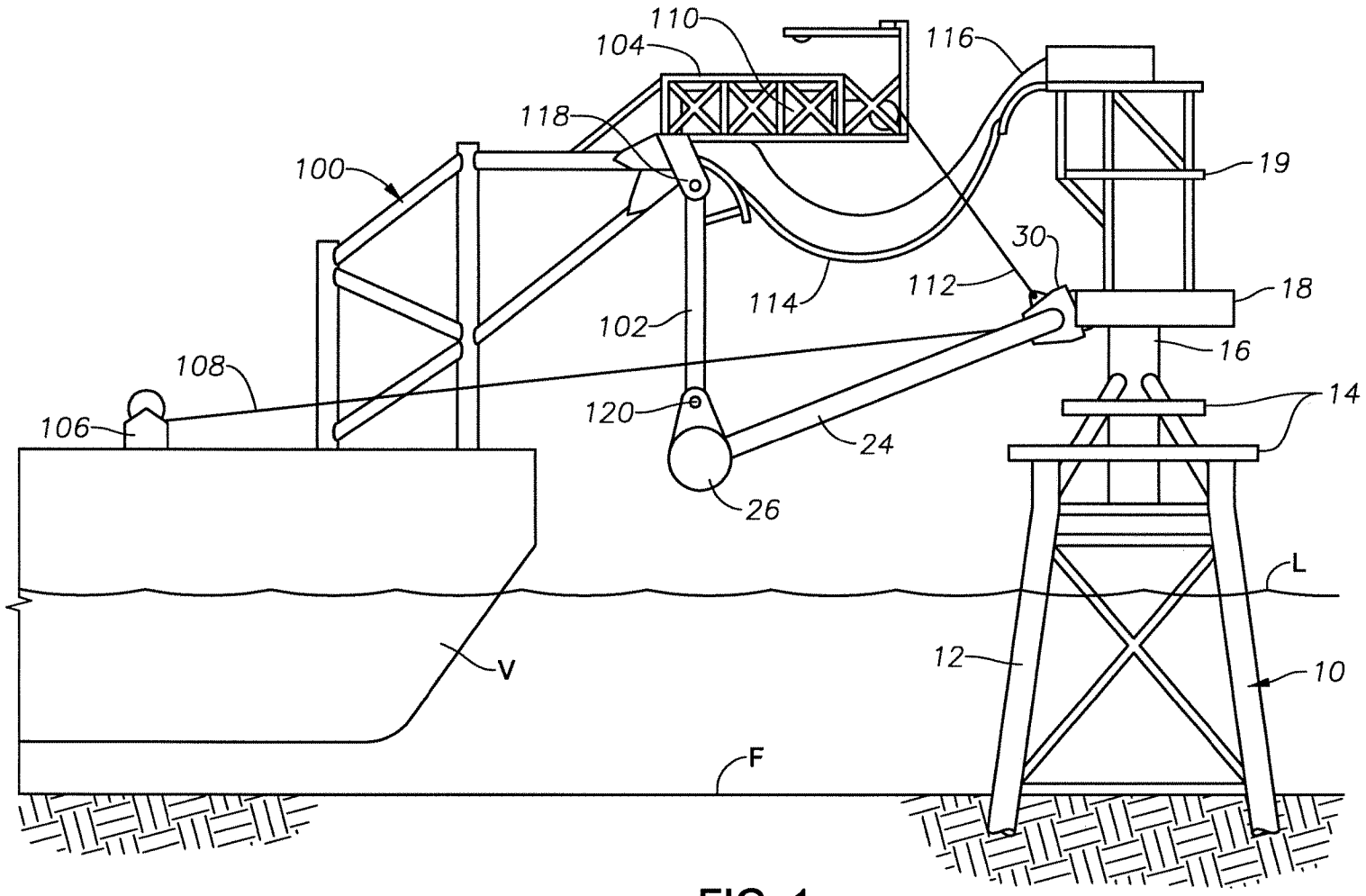
FIG. 1 is an elevation view showing a floating vessel or ship moored to a tower via a tower yoke.

The preferred embodiment of the present invention will now be discussed with reference to the drawings. FIG. 1 shows a tower 10 including a jacket structure 12 fixedly attached to the sea floor F, typically via piling. The tower 10 also includes a plurality of decks 14 mounted on the jacket structure 12 at various elevations above the water level L, typically mean water level, and a vertical support column 16. It is understood by those of skill in the art that the decks 14 are arranged and designed to support various equipment, including manifolds, etc. A turntable 18 is fastened to the support column 16, with a turntable bearing 28 (FIG. 5), preferably a roller bearing, to allow a floating vessel V moored to the tower 10 to freely weathervane about the tower 10. Preferably, one or more decks, including a hose deck 19, are located above the turntable 18 and rotate with the turntable 18.

Figure 2:
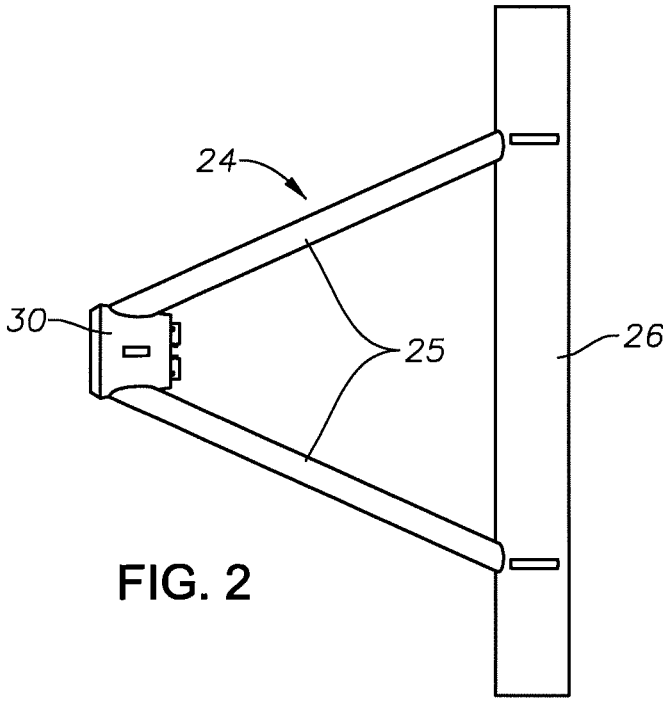
FIG. 2 is a plan view of the yoke.

The floating vessel V is moored to the tower 10 via a yoke 24. FIG. 2 shows a plan view of a yoke 24. Typically, the yoke 24 is formed primarily from tubular members. As shown in FIG. 2, the yoke 24 is generally triangular in shape when viewed in plan view. The yoke 24 includes a large ballast tank 26 adapted to be filled with water or other ballast to provide the necessary restoring force to minimize motions of the vessel V when connected to the tower 10. The yoke 24 includes a pair of legs 25 angled towards each other. Each leg 25 has one end connected to the ballast tank 26 and a second end connected to a yoke coupler 30. In the preferred embodiment, the yoke 24 is arranged and designed to be connected to and disconnected from a yoke head 20 while on location. Preferably, the yoke coupler 30 is a conical section for alignment and connection with the yoke head 20 as best shown in FIG. 4.

Figure 3:
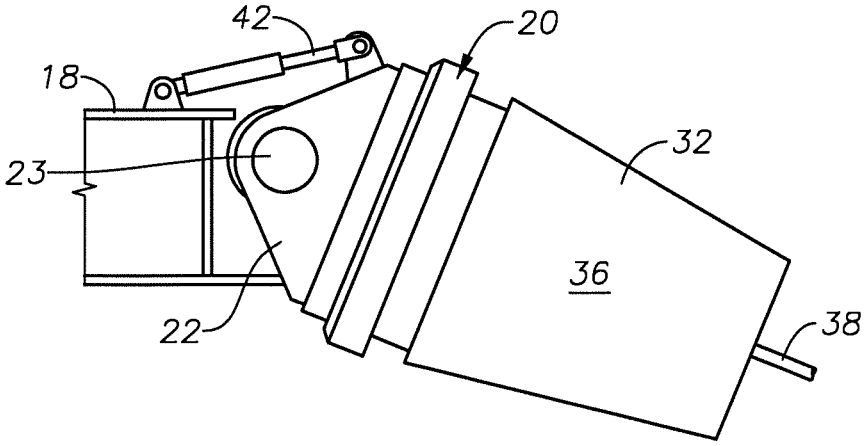
FIG. 3 is an elevation view showing a connection between a turntable and a yoke head.
Figure 4:
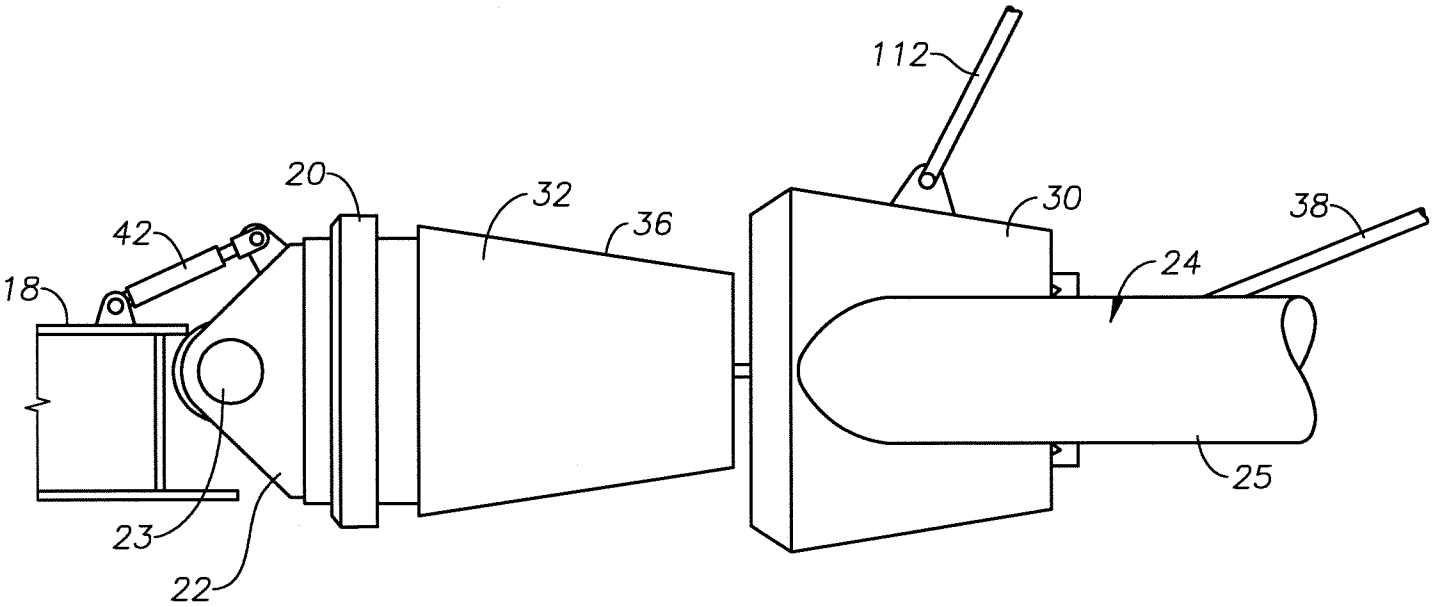
FIG. 4 is an elevation view showing a preferred embodiment of the invention in which the yoke and yoke head are in a disconnected condition.
Figure 5:
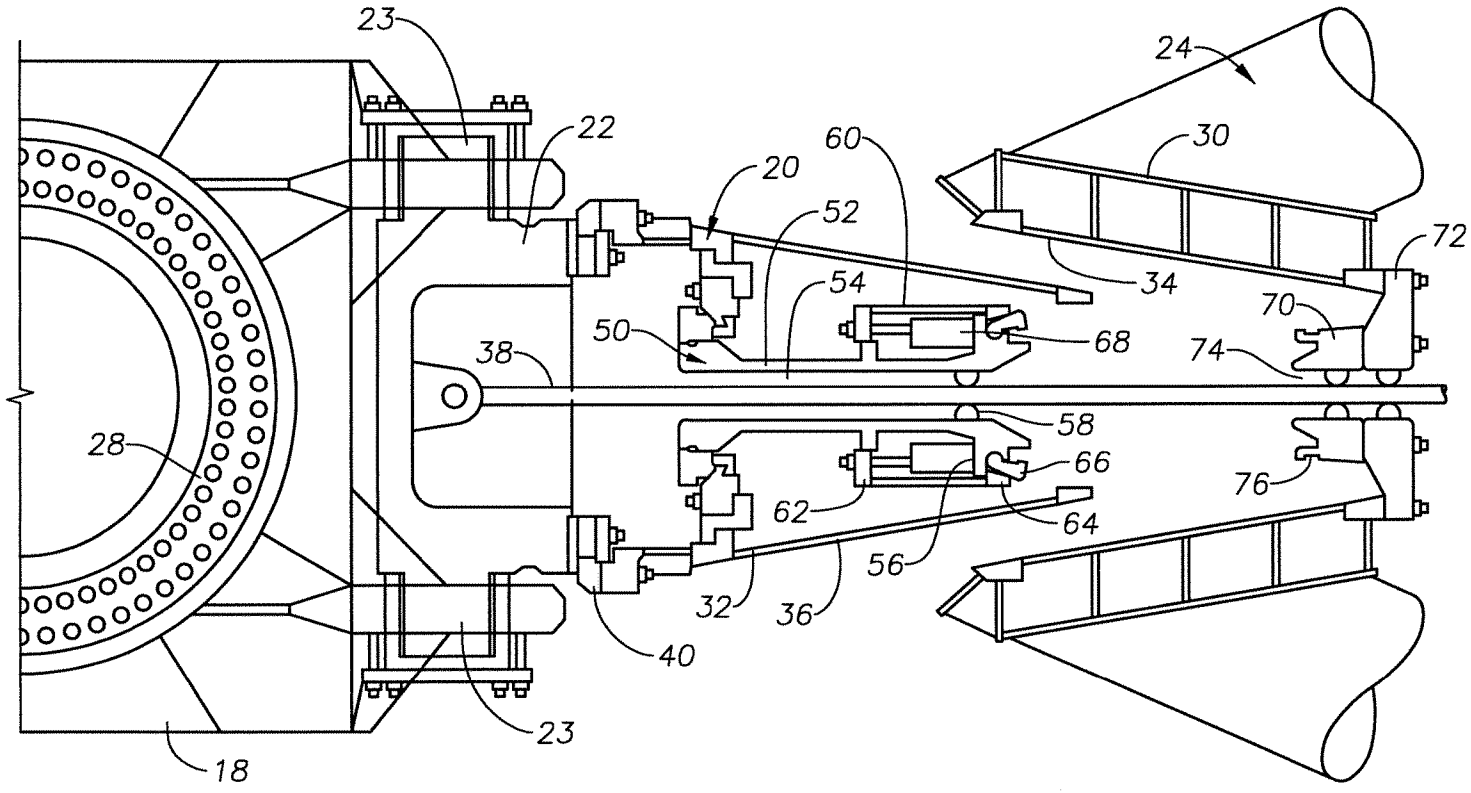
FIG. 5 is a cross-sectional view of the preferred embodiment showing the yoke and yoke head in a disconnected condition.

In the preferred embodiment, the yoke head 20 is mounted to the turntable 18 via a pair of trunnions 23 for pivotal movement relative to the turntable 18 as shown in FIGS. 3-5. Referring to FIG. 5, the pair of trunnions 23 extend outwardly from a trunnion housing 22. A pull-in line 38 attached to the trunnion housing 22 of the yoke head 20 serves as a guide for the yoke 24 and yoke head 20 during vessel V pull-in and connection.

As shown in FIG. 5, a yoke head conical section 32 is connected to the trunnion housing 22, preferably via a roll bearing 40. The yoke head roll bearing 40 allows the head conical section 32 to rotate relative to the trunnion housing 22.

In the preferred embodiment the yoke head conical section 32 is arranged and designed to cooperate and interface with the yoke conical section 30. This interface includes two conical machined surfaces: an inner surface 34 on the yoke conical section 30 (female) and an outer surface 36 on the head conical section 32 (male) as shown in FIG. 5. The conical sections 30 and 32 at the ends of the yoke 24 and the yoke head 20, respectively, allow for guidance during connection and allow for load transfer from the yoke 24 to the yoke head 20.

In the preferred embodiment as shown in FIG. 5, a hydraulic connector 50 is positioned inside of the yoke head conical section 32 and is actuated from the tower side by accumulators and telemetry controlled valves. Accumulators and telemetry controlled valves are well known to those skilled in the art. The hydraulic connector 50 has a stationary housing 52 mounted within the head conical section 32. The stationary housing 52 is preferably a substantially cylindrical housing having a bore 54 therethrough. The stationary housing 52 includes an outwardly facing shoulder 56 and one or more line guides 58 within the bore 54. The pull-in line 38 extends through the bore 54 and between the one or more line guides 58. The hydraulic connector 50 also includes a movable sleeve 60 extending around the outwardly facing shoulder 56. The movable sleeve 60 includes an inwardly directed flange 62 at one end and a band 64 at an opposite end. The band 64 contacts one or a plurality of pivot fingers 66. One or more actuators 68, preferably hydraulic cylinders, are positioned between and connected to the outwardly facing shoulder 56 of the stationary housing 52 and the inwardly directed flange 62 of the movable sleeve 60. Preferably, when more than one actuator 68 is used, all of the actuators are controlled by a singular control to provide simultaneous operation and movement of the movable sleeve 60.

A mating hub 70 of the hydraulic connector 50 is mounted within the yoke conical section 30 by means of an adapter 72. Preferably, the mating hub 70 and the adapter 72 are annular members having a common bore 74 extending therethough. Preferably, one or more line guides 58 are mounted within the common bore 74. The pull-in line 38 extends through the common bore 74 and between the one or more line guides 58.

Figure 6:
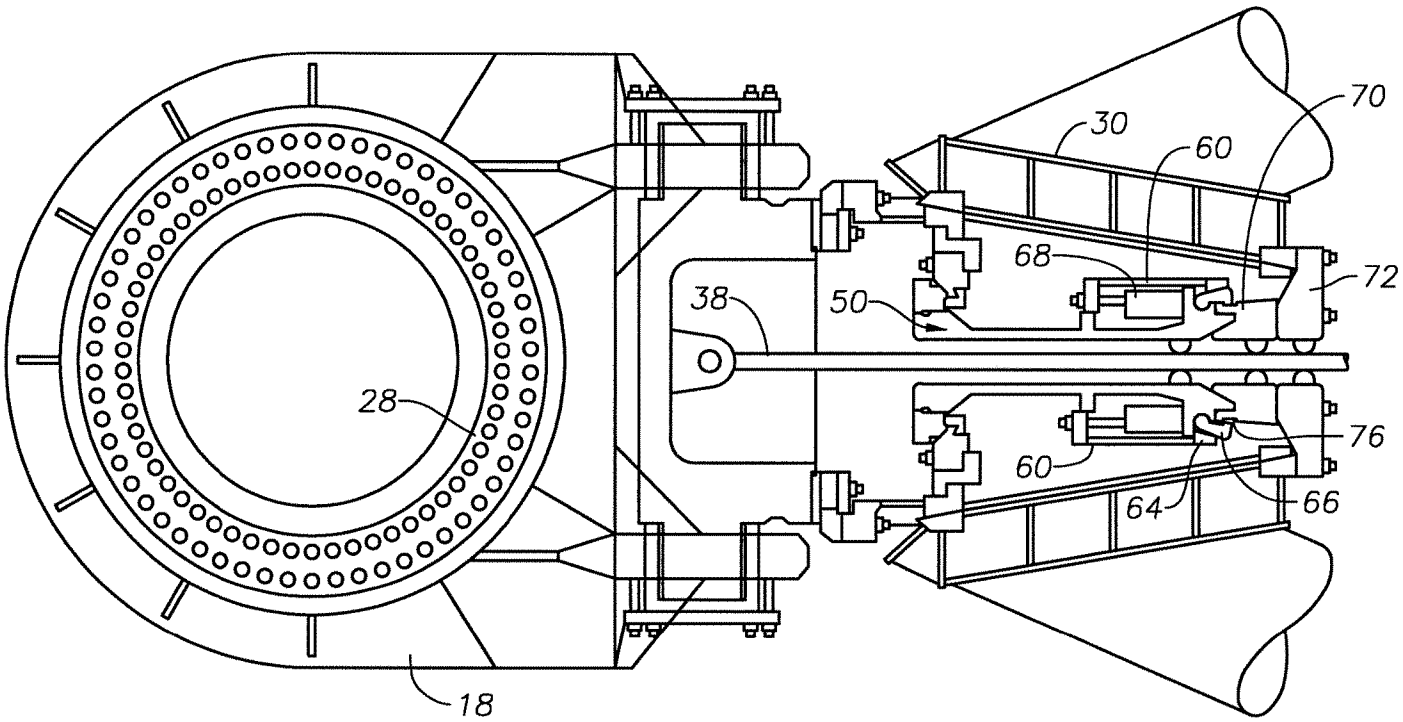
FIG. 6 is a cross-sectional view showing the yoke and the yoke head in a connected condition, with the hydraulic connector engaged in the upper half of the figure and disengaged in the lower half of the figure.

FIG. 5 shows the yoke 24 and the yoke head 20 in a disconnected condition and FIG. 6 shows the yoke 24 and the yoke head 20 in a connected condition, with the hydraulic connector 50 engaged in the upper half of the figure and disengaged in the lower half of the figure for exemplary purposes. When the hydraulic connector 50 is engaged, it provides a preload to the conical structural interfaces 34 and 36. With reference to FIG. 5 and the lower half of FIG. 6, the rod of the actuator 68 is extended such that the band 64 of the movable sleeve 60 allows the pivot fingers 66 to pivot outwardly. Upon engagement of the end of the stationary housing 52 with the end of the mating hub 70 and the engagement of the conical structural interfaces 34 and 36, the actuators 68 are actuated to move the movable sleeve 60 in the direction of the mating hub 70 until the pivot fingers 66 are forcibly inserted into the mating hub recess 76 as shown in the upper half of FIG. 6. With the pivot fingers 66 forcibly inserted in the mating hub recess 76, the yoke 24 is securely connected to the yoke head 20. Preferably, secondary mechanical locks (not shown) in line with the actuators 68 keep the connector locked without the need of hydraulic pressure. Secondary mechanical locks may be interference sleeve locks such as the Bear-Loc™ locking device, manufactured by Wellman Dynamics Machining and Assembly Inc. of York, Pa.

Referring to FIG. 1, the floating vessel V is equipped with a support structure 100 preferably including a pair of mooring links 102. The mooring links 102 are connected to the support structure via upper U-joints 118. Lower U-joints 120 connect the mooring links 102 to the ballast tank 26 of the yoke 24. The support structure 100 with the pair of mooring links 102 are arranged and designed to suspend the ballast tank 26 of the yoke 24. A motion compensated winch or lifting device 110 is mounted on a cantilevered section 104 of the mooring support structure 100. The motion compensated winch 110 may be located elsewhere on the mooring support structure 100 or vessel V and the line 112 reeved through sheaves located on the mooring support structure 100 and cantilevered structure 104. The motion compensated winch 110 is arranged and designed to support the yoke 24 during disconnection and reconnection. A mooring connection winch 106 on the vessel V is arranged and designed to pull the vessel V to the tower 10 and provide guidance for the structural connection of the yoke 24 to the yoke head 20. Preferably, the rope or cable 108 of the mooring connection winch 106 is connected to the pull-in line 38 attached to the trunnion housing 22 of the yoke head 20.

Still referring to FIG. 1, during normal operations with the vessel V moored to the tower 10, one or more hoses or flow lines 114 and cables 116 from the vessel V to the tower 10 are typically connected for process flow. The link arms 102 are connected to the ballast tank 26 of the yoke 24 and support the ballast tank 26 above the water level L. In the event of excessive environmental conditions anticipated at the tower location, the following procedures are permitted as a result of the preferred embodiment of the present invention.

Initially, the hoses or flow lines 114 and cables 116 are disconnected at the tower interface and retrieved to the vessel V and stored for transportation. An alternative configuration allows the hoses 114 and cables 116 to be disconnected at the vessel V and stored on the hose deck 19 of the tower 10. Referring to FIG. 1, a winch line 112 of the motion compensated winch 110 is attached to the yoke 24 to suspend the yoke coupler 30 end of the yoke 24 after disconnection from the yoke head 20. A cylinder 42, preferably a hydraulic cylinder (FIG. 4), attached to the trunnion housing 22 of the yoke head 20 and to the tower turntable 18 orients the yoke head 20 in a near horizontal orientation (or at the proper angle) during disconnection of the yoke 24, while the yoke 24 is disconnected and during reconnection of the yoke 24. The hydraulic cylinders 68 of the hydraulic connector 50 inside the yoke head 20 are actuated to move the movable sleeve 60 from the position shown in the upper half of FIG. 6 to the position shown in the lower half of FIG. 6, allowing the yoke 24 to disconnect from the tower structure 10 at the yoke head 20 while being supported by the motion compensated winch 110 and the mooring links 102 of the vessel support structure 100. The yoke 24 is stored and pulled against fenders of the vessel V and the yoke coupler end 30 is fastened to the cantilevered structure 104 for sailing of the vessel V.

During reconnection of the yoke 24 to the yoke head 20, the motion compensated winch 110 is attached to the yoke 24 to suspend the yoke coupler 30 end of the yoke 24. The pull-in line 38 attached to the inside of the trunnion housing 22 is retrieved, and the pull-in line 38 or winch cable 108 of the mooring connection winch 106 is inserted through the mating hub 70 of the yoke 24. The pull-in line 38 is connected to the winch cable 108 of the mooring connection winch 106. The vessel V is pulled towards the tower 10 for connection. The pull-in line 38 extends through the plurality of line guides 58 inside the connector 50 and mating hub 70, providing for initial guidance of the yoke head 20 and yoke 24 for connection. Final guidance is obtained by the mating conical surfaces 34 and 36 of the yoke 24 and yoke head 20, respectively, in addition to the connector 50 and hub 70 interface. The trunnion cylinder 42 supports the yoke head 20 for alignment and reconnection. The mooring links 102 and the yoke lifting device 110 support the yoke 24 for alignment and reconnection. Once the mating conical surfaces 34 and 36 are completely engaged, the hydraulic cylinders 68 are actuated to structurally connect the connector 50 to the mating hub 70. The vessel is now moored. The trunnion cylinder 42 is then disengaged from the yoke head 20 and the yoke lifting device 110 is disengaged from the yoke 24. Preferably, the winch cable 108 of the mooring connection winch 106 is also disconnected from the pull-in line 38 in preparation for the next yoke disconnection.

Preferably, the disconnection takes place at the yoke head 20 which allows the yoke 24 to be transported with the vessel V. This leaves the tower 10 and the yoke head 20 attached to the tower 10 to survive the large storm. The hydraulic connector 50 is placed at the yoke/yoke head disconnection interface to allow for quick disconnection under load. Preferably, the yoke disconnection interface is located as close to the yoke head roll bearing 40 as possible. The yoke 24 is suspended by a motion compensated winch 110 and attached to the vessel V for evasion of the storm.

While preferred embodiments of the present invention have been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

I claim:

1. A disconnectable tower yoke assembly, the tower yoke assembly for connecting a floating vessel to a tower structure in a body of water, comprising:

a yoke head having a first portion connected to the tower structure, a second portion connected to the first portion, and a head connector portion;

a yoke having a yoke coupler arranged and designed to connect to and disconnect from the yoke head, the yoke including a ballast tank distal of the yoke coupler, and the yoke coupler including a coupler connector portion, wherein the head connector portion and coupler connector portion are arranged and designed to matingly engage one another;

one of the head and coupler connector portions in communication with at least one actuator, the at least one actuator arranged and designed to secure the head and coupler connector portions in mating engagement and arranged and designed to allow the head and coupler connector portions to disengage from one another.

2. The disconnectable tower yoke assembly of claim 1, wherein the at least one actuator is in hydraulic communication with one of the head and coupler connector portions.

3. The disconnectable tower yoke assembly of claim 1, wherein the at least one actuator is in communication with the head connector portion.

4. The disconnectable tower yoke assembly of claim 1, wherein the second portion of the yoke head comprises the at least one actuator and a head conical section, wherein the yoke coupler comprises a yoke conical section, and wherein the head conical section is arranged and designed to cooperate and interface with the yoke conical section by providing guidance during connection of the yoke to the yoke head.

5. The disconnectable tower yoke assembly of claim 4, wherein the head conical section has a conical surface and the yoke conical section has a conical surface, and the head conical surface and the yoke conical surface are arranged and designed to be completely engaged when the head conical section is fully interfaced with the yoke conical section.

6. The disconnectable tower yoke assembly of claim 5, wherein the head connector portion and coupler connector portion are arranged and designed to matingly engage one another with the head conical surface and yoke conical surface completely engaged.

7. The disconnectable tower yoke assembly of claim 1, wherein the yoke head second portion is connected to the yoke head first portion such that the yoke head second portion is allowed to partially rotate relative to the yoke head first portion.

8. The disconnectable tower yoke assembly of claim 7, wherein the yoke head first portion is connected to the tower structure such that it can vertically pivot about a horizontal axis.

9. A disconnectable tower yoke assembly, the tower yoke assembly for connecting a floating vessel to a tower structure in a body of water, the tower structure having a turntable for rotation about a vertical axis, the disconnectable tower yoke assembly comprising:

a yoke head connected to the turntable in a manner permitting the yoke head to vertically pivot about a horizontal axis, the yoke head including a head connector element and a head conical section;

a yoke having a pair of spaced legs, one end of each leg is attached to a yoke coupler, the yoke coupler including a coupler connector element and a coupler conical section;

the head and coupler connector elements being engageable to provide a rigid interconnection therebetween;

an actuator arranged and designed to secure engagement of the head connector element with the coupler connector element;

a cable having a first end attached to an interior portion of the yoke head with the cable extending through the head and coupler conical sections and through the head and coupler connector elements, the cable providing initial guidance of the yoke for connection with the yoke head;

the head conical section is arranged and designed to cooperate and interface with the coupler conical section by providing guidance during connection of the yoke to the yoke head.

10. The disconnectable tower yoke assembly of claim 9, wherein the head conical section has a conical surface and the coupler conical section has a conical surface, and the head conical surface and the coupler conical surface are arranged and designed to be completely engaged when the head conical section is fully interfaced with the coupler conical section.

11. The disconnectable tower yoke assembly of claim 10, wherein the head and coupler connector elements are arranged and designed to matingly engage one another with the head conical surface and coupler conical surface completely engaged.

12. The disconnectable tower yoke assembly of claim 9, further comprising a second actuator arranged and designed to be attached to the yoke head to provide a desired angular orientation of the yoke head during connection of the yoke to the yoke head.

13. The disconnectable tower yoke assembly of claim 9, further comprising a second actuator arranged and designed to be attached to the yoke head to provide a desired angular orientation of the yoke head during disconnection of the yoke from the yoke head.

14. The disconnectable tower yoke assembly of claim 13, wherein the second actuator is a hydraulic cylinder having one end attached to the yoke head and a second end attached to the turntable.

15. A method for a floating vessel to disconnect a mooring yoke from a yoke head attached to a tower structure, the vessel provided with a motion compensated winch assembly and a yoke support structure supporting one end of the yoke, the steps comprising:

attaching a winch line from the motion compensated winch assembly to a coupler end of the yoke connected to the yoke head;

disengaging a head connector element of the yoke head from a coupler connector element of the yoke;

maintaining desired angular orientation of the yoke head upon the head and coupler connector elements disengaging; and supporting the yoke by the motion compensated winch assembly and the yoke support structure of the vessel as the yoke disconnects from the yoke head.

16. The method of claim 15, further comprising the step of:

separating an inner surface of a yoke coupler from contacting engagement with an outer surface of the yoke head.

17. The method of claim 15, further comprising the step of:

moving the yoke in a substantially axial direction away from the yoke head.

18. A disconnectable tower yoke assembly, the tower yoke assembly for connecting a floating vessel to a tower structure in a body of water, the tower structure having a turntable for rotation about a vertical axis, the disconnectable tower yoke assembly comprising:

a yoke head connected to the turntable in a manner permitting the yoke head to vertically pivot about a horizontal axis, the yoke head including a head connector element and a head conical section;

a yoke having a pair of spaced legs, one end of each leg is attached to a yoke coupler arranged and designed to connect to and disconnect from the yoke head, the yoke coupler including a coupler connector element and a coupler conical section;

wherein the head connector element and the coupler connector element being engageable to provide a rigid interconnection therebetween;

an actuator positioned within the head conical section and arranged and designed to secure engagement of the head connector element with the coupler connector element;

the head conical section is arranged and designed to cooperate and interface with the coupler conical section by providing guidance during connection of the yoke coupler to the yoke head.

19. The disconnectable tower yoke assembly of claim 18, wherein the head connector element is positioned within the head conical section.

20. The disconnectable tower yoke assembly of claim 19, wherein the coupler connector element includes a mating hub positioned within the coupler conical section.

21. The disconnectable tower yoke assembly of claim 18, wherein the head conical section has a conical surface and the coupler conical section has a conical surface, and the head conical surface and the coupler conical surface are arranged and designed to be completely engaged when the head conical section is fully interfaced with the coupler conical section.

22. The disconnectable tower yoke assembly of claim 21, wherein the head and coupler connector elements are arranged and designed to matingly engage one another with the head conical surface and coupler conical surface completely engaged.

23. The disconnectable tower yoke assembly of claim 18, further comprising a second actuator arranged and designed to be attached to the yoke head to provide a desired angular orientation of the yoke head during connection of the yoke to the yoke head.

24. The disconnectable tower yoke assembly of claim 18, further comprising a second actuator arranged and designed to be attached to the yoke head to provide a desired angular orientation of the yoke head during disconnection of the yoke from the yoke head.

25. The disconnectable tower yoke assembly of claim 23, wherein the second actuator is a hydraulic cylinder having one end attached to the yoke head and a second end attached to the turntable.

* * * * *